United States Patent [19]

Tiemann et al.

[11] Patent Number: 4,490,594

[45] Date of Patent: Dec. 25, 1984

[54] HIGH VOLTAGE CIRCUIT BREAKER

[75] Inventors: Wilhelm Tiemann, Bubenreuth; Jobst Verleger, Erlangen, both of Fed. Rep. of Germany

[73] Assignee: Siemens Aktiengesellschaft, Munich, Fed. Rep. of Germany

[21] Appl. No.: 472,490

[22] Filed: Mar. 7, 1983

[30] Foreign Application Priority Data

Mar. 18, 1982 [DE] Fed. Rep. of Germany ..... 3209968

[51] Int. Cl.[3] ..... H01H 33/72

[52] U.S. Cl. ..... 200/148 R; 200/148 A; 200/275

[58] Field of Search ..... 200/148 R, 148 A, 148 B, 200/148 C, 148 D, 148 E, 148 F, 148 G, 148 H, 148 J, 148 BV, 150 G, 275, 279

[56] References Cited

U.S. PATENT DOCUMENTS 3,704,354 11/1972 Lagofun ..... 200/148 G
4,403,125 9/1983 Yamaoka et al. ..... 200/148 R

FOREIGN PATENT DOCUMENTS 1055643 4/1959 Fed. Rep. of Germany .
2220897 10/1975 Fed. Rep. of Germany .

*Primary Examiner*—A. D. Pellinen
*Assistant Examiner*—Morris Ginsburg
*Attorney, Agent, or Firm*—Kenyon & Kenyon

[57] ABSTRACT

An electrode system for a high voltage circuit breaker is disclosed which comprises at least one nozzle-like electrode end in which the contour of the end face in cross section in the axial direction of the electrode end forms part of an ellipse. The ellipse may preferably be inclined relative to the axis of rotation of the electrode. The electrode system can be used in circuit breakers with two oppositely-disposed nozzle-like electrode ends and in disconnect switches with only a single nozzle-like electrode end. Concentration of the field at the end face of the nozzle-like end is avoided and thereby dielectric strength is increased.

8 Claims, 1 Drawing Figure

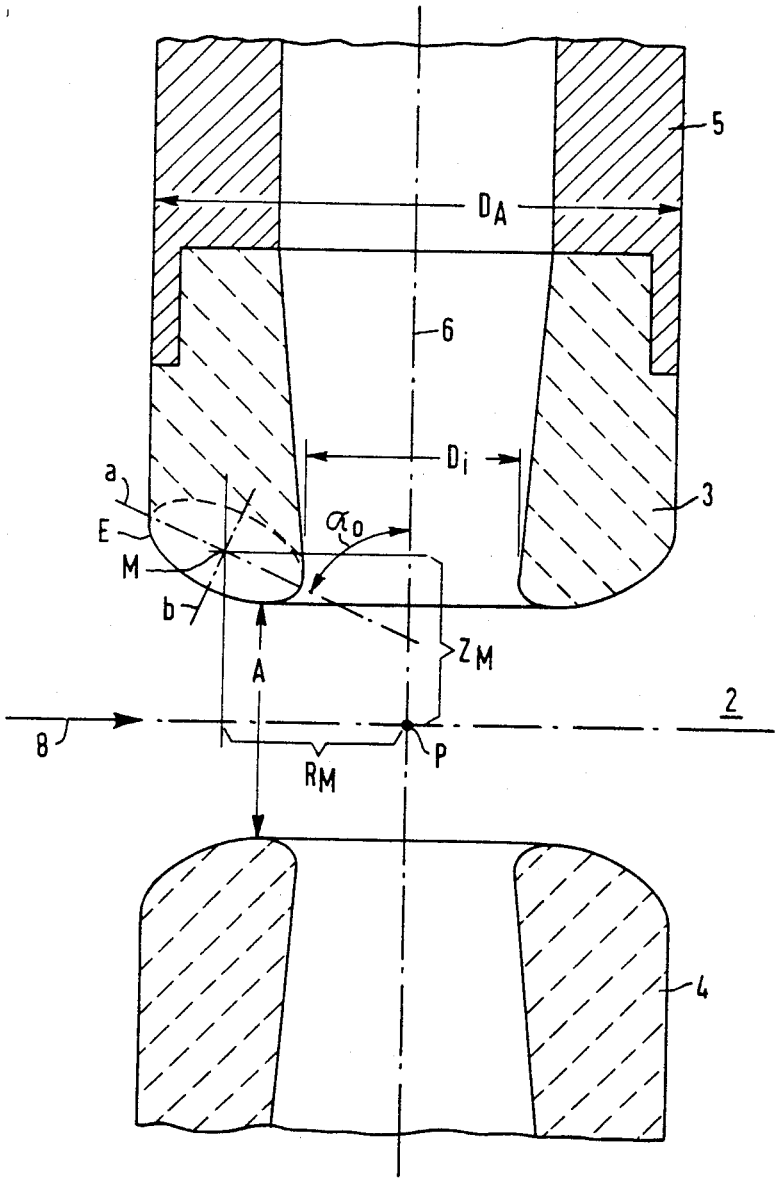
5
$D_A$
6
$D_i$
a
E
M
b
$\alpha_0$
3
$Z_M$
A
2
8
$R_M$
P
4

HIGH VOLTAGE CIRCUIT BREAKER

BACKGROUND OF THE INVENTION

The present invention relates to a high voltage circuit breaker, particularly a blast-piston breaker.

In high-voltage installations with a rated voltage of, for example, more than 100 kV, compressed-gas circuit breakers are used, as is well known, which are generally blast-piston ("puffer") breakers, or may also operate according to the two-pressure system. A fluorine-containing electronegative gas, particularly sulfurhexafluroide (SF6), is used as both the compressed gas and the insulating gas. The electrodes are hollow and have nozzle-like ends through which the switching gases are removed, and are mutually oppositely disposed. At least the part of the electrode adjoining its respective end is made of carbon, particularly graphite. The inside diameters of the nozzle-like ends and the spacing between the nozzle-like ends of the two electrodes are chosen so that good quenching action on an arc which is drawn when the breaker opens is obtained.

In breakers in which the nozzle-like ends of the two electrodes are arranged opposite each other spaced by a fixed distance, the arc is drawn by a movable bridging contact which in general is disposed at the outer cylindrical surface of the nozzle-like ends of the electrodes. The arc can be drawn further by a contact within the nozzle-like ends or by providing movable nozzle-like ends which are separated from each other by an axial distance for interrupting the current. By substantially radially outwardly directing the gas flow, the base of the arc is blown into the mouths of the nozzle-like ends. In high-voltage breakers, for example having a rated voltage of 245 kV and more, several such interrupter units of high breaking capacity can be connected in series.

It is known that the switching gap must be cleared and kept free of charge carriers after a quenching operation. Heretofore this was accomplished by blasting the arc by means of special coaxial contacts movable from within the nozzle-like ends of the electrode into the space between the nozzle-like ends. The individual nozzle-like electrode ends of the interrupter unit were shaped at their mutually opposite end faces so that a minimum distance was obtained between the electrodes to provide the required dielectric strength in the cold condition. The passage openings of the breaker contacts could be configured to prevent the arc from passing to the nozzle-like ends.

According to DE-AS 10 55 643, the end faces of the nozzle-like ends were shaped so that they formed a surface of revolution, the generatrix of which is a circular arc. In a two electrode system in which the nozzle-like end faces oppose each other at a fixed distance, the end faces of the electrodes were shaped such that the main cylindrical portion of the electrodes had a curvature greater than that of the nozzle-like ends, as disclosed in DE-AS 22 20 897, in order to guide the flow of the gas stream radially to the axis of rotation of the system.

OBJECTS AND SUMMARY OF THE INVENTION

It is an object of the present invention to provide a high-voltage breaker of the above described type in which the switching gap of the interrupter unit has a high dielectric strength, preferably sufficient for resisting surge voltages, especially in the event of a lightning surge into the system.

It is another object of the present invention to improve radial blasting in the space between the nozzle-like ends of the interrupter electrodes during quenching of an arc in compressed-gas breakers of the above-described type.

The above and other objects are achieved by the invention disclosed herein according to which the cooling action of the quenching gas during quenching of an arc can be increased even though the spacing of the nozzle-like ends of the electrodes is decreased. However, spacing of the electrode ends is substantially determined by the magnitude of the switching voltage which the breaker must withstand when it is opened. The invention is based on the recognition by the applicants that the spacing can be reduced if a non-uniform field distribution at the electrode ends is avoided.

According to the invention, the cross-sectional contours of the end faces of the nozzle-like electrode ends in the axial direction of the electrode form part of the ellipse. A uniform field distribution is thereby obtained over the electrode end face and the part of the electrode end adjoining the end face. The dielectric strength of the interrupter unit is increased accordingly and the spacing between nozzle-like electrodes ends can be reduced considerably without affecting cold strength. Furthermore, the current limit within which an approximately cylindrically-shaped arc is obtained is increased substantially.

In a preferred embodiment of a compressed-gas breaker, the generatrix of the electrode end face forms part of an ellipse inclined in such a manner that its principal major axis forms an acute angle with respect to the axis of rotation of the electrode system, the angle being open in a direction facing into the mouth of the nozzle-like electrode end. Thereby, a profile of the cross-section of oppositely disposed nozzle-like ends is obtained which is narrowed in the manner of a Laval nozzle in the radial flow direction of the compressed gas. The cross-section starts with a smaller curvature and is then flared out to a larger curvature in the flow direction after a constriction. In the preferred embodiment, the narrowest point of the nozzle-like ends is close to the axis of the nozzle-like electrode end and the blasting effect on an arc is increased by a shift in the velocity maximum of the radial gas flow closer to the stagnation point of the flow.

The above and other objects, features, aspects and advantages of the present invention will be more readily perceived from the following description of the preferred embodiments thereof when considered with the accompanying drawing and appended claims.

BRIEF DESCRIPTION OF THE DRAWINGS

The present invention is illustrated by way of example and not limitation in the FIGURE of the accompanying drawing which is a schematic axial section view of the electrode portion of a high voltage circuit breaker according to the invention.

DESCRIPTION OF THE PREFERRED EMBODIMENTS

The electrode system designated 2 in the FIGURE is symmetrical about an axis of rotation 6 and includes hollow, cylindrical, nozzle-like electrode ends 3 and 4, arranged co-axially with respect to each other. The nozzle-like ends have an outside diameter "DA" of, for example about 60 to 100 mm, and an inside diameter "Di" at the mouth of the electrode end of, for example, about 25 to 50 mm, and form the two electrode ends of an interrupter unit, two of which, for example, can be connected in series in a breaker to achieve a rated voltage of 245 kV. The end faces of the electrode ends are arranged opposite each other at a fixed distance A, for example, about 20 to 50 mm. The electrode ends 3 and 4 may be made for example, of carbon, particularly graphite, and inserted into hollow cylindrical metallic mounts, of which only one designated 5 is indicated in the FIGURE. The contours in the axial direction of the end faces of the mutually opposite nozzle-like ends 3 and 4 each form part of an ellipse E, the center of which is designated M. Since a non-uniform field distribution and a concentration of the field at the end faces of the nozzle-like electrode ends 3 and 4 cannot occur in the electrode system depicted in the FIGURE, the dielectric strength of the interrupter unit is increased accordingly.

In a preferred embodiment of the compressed-gas breaker, the end faces of the nozzle-like ends 3 and 4 are shaped so that the ellipse E is inclined relative to the axis of rotation 6. Its major principal axis "a" forms an acute angle $\alpha_o$ with the axis of rotation 6 which opens in a direction facing into the mouth of the nozzle-like electrode end, and which may, for example, be about 45 to 75 degrees and preferably about 55 to 65 degrees. The center M of the ellipse E is determined by distance $R_M$ from the axis of rotation 6 and the distance $Z_M$ from the central plane of the electrode system 2 indicated by the horizontal dash-dotted line in the FIGURE. The position and size of the ellipse E is determined by its major principal axis "a" and its minor principal axis "b" as well as by the coordinates of the center M and the inclination of its major and minor axes relative to the axis of rotation 6, which are fixed by the angle $\alpha_o$. The profile of the cross-section of the nozzle-like ends 3 and 4 is thereby contoured, in the direction of a radial gas stream indicated by the arrow 8, in the manner of a Laval nozzle which causes a high flow velocity of the compressed-gas at the narrowest point between the electrode end faces determined by the distance A. By the curvature of the end face, which is initially small in the flow direction, the narrow point or construction which is indicated by the arrows for the distance A, and thereby, the maximum velocity of the gas flow, is shifted to a stagnant point P on the axis of rotation 6. Thereby, correspondingly good blasting of an arc drawn after opening of the breaker at the nozzle-like ends 3 and 4 is obtained.

In the illustrated embodiment, a circuit breaker with two electrodes was selected to form a double nozzle-like electrode system. The nozzle-like end according to the invention however, can also be utilized in high-voltage breakers with only a single nozzle-like electrode end, for example, in disconnect switches.

Certain changes and modifications of the embodiments of the invention disclosed herein will be readily apparent to those skilled in the art. It is the applicants' intention to cover by their claims all those changes and modifications which could be made to the embodiments of the invention herein chosen for the purpose of disclosure without departing from the spirit and scope of the invention.

What is claimed is:

1. In a high voltage circuit breaker comprising two electrodes both of which have a hollow, nozzle-like electrode end, with the end faces of the electrode ends being formed so that high dielectric strength is obtained with small spacing between ends, the improvement comprising the contours in cross-section of the end faces of the hollow, nozzle-like electrode ends forming part of an ellipse in the axial direction of the respective electrode ends.

2. The improvement according to claim 1 wherein the generatrix of each of the end faces forms part of an ellipse inclined such that its major principal axis forms an acute angle with the axis of rotation of the electrode ends, said angle being open in a direction facing the mouth of the respective electrode.

3. The improvement according to claim 1 wherein the profile of the cross-section of the nozzle-like ends in a radial direction is in the form of a Laval nozzle.

4. The improvement according to claim 2 wherein the profile of the cross section of the nozzle-like ends in a radial direction is in the form of a Laval nozzle.

5. In a high voltage circuit breaker comprising two electrodes one of which has a hollow, nozzle-like electrode end, with the end faces of the electrode ends being formed so that high dielectric strength is obtained with small spacing between the ends, the improvement comprising the contour in cross-section of the end face of the hollow, nozzle-like electrode end forming part of an ellipse in the axial direction of the nozzle-like electrode end.

6. The improvement according to claim 5 wherein the generatrix of the end face of the nozzle-like electrode end forms part of an ellipse inclined such that its major principal axis forms an acute angle with the axis of electrodes, said angle being open in a direction facing the mouth of the nozzle-like electrode end.

7. The improvement according to claim 5 wherein the profile of the cross section of the nozzle-like end in a radial direction is in the form of a Laval nozzle.

8. The improvement according to claim 6 wherein the profile of the cross section of the nozzle-like end in a radial direction is in the form of a Laval nozzle.

* * * * *